United States Patent [19]

Furukawa

[11] Patent Number: 4,580,393

[45] Date of Patent: Apr. 8, 1986

[54] PACKING APPARATUS

[75] Inventor: Takao Furukawa, Onomichi, Japan

[73] Assignees: Furukawa Mfg. Co., Ltd., Tokyo; Furukawa Kogyo Co., Ltd., Hiroshima, both of Japan

[21] Appl. No.: 599,153

[22] Filed: Apr. 11, 1984

[51] Int. Cl.[4] ..... B65B 31/00

[52] U.S. Cl. ..... 53/512; 53/253; 53/571

[58] Field of Search ..... 53/79, 91, 95, 96, 275, 53/403, 405, 432, 434, 512, 571, 253

[56] References Cited

U.S. PATENT DOCUMENTS

| | | | |
|---|---|---|---|
| 2,630,955 | 3/1953 | Moses et al. | 53/95 |
| 2,966,019 | 12/1960 | Grafingholt | 53/91 |
| 3,010,264 | 11/1961 | Christensson | 53/512 |
| 3,220,157 | 11/1965 | Buchner | 53/95 |
| 3,910,009 | 10/1975 | Canfield | 53/95 |
| 3,958,391 | 5/1976 | Kujubu | 53/95 |
| 4,312,171 | 1/1982 | Vadas | 53/403 |

*Primary Examiner*—John Sipos
*Assistant Examiner*—Donald R. Studebaker
*Attorney, Agent, or Firm*—Stevens, Davis, Miller & Mosher

[57] ABSTRACT

A vacuum packing apparatus for vacuum packing objects into flexible bags. The apparatus has first and second gears rotatable around a pair of spaced apart vertical axes and an endless chain which is engaged with the gears. The first gear has a plurality of chambers spaced at intervals from one another, and the chain carries a plurality of lids for hermetically sealing the chambers. Each lid includes a pair of clippers for hanging the bags in suspension with the bag openings oriented upwardly. A bag feed unit feeds bags to the clippers and a hopper unit feeds objects into the bags while the bags are supported in suspension by the clippers. Each bag, while being supported in suspension by a pair of clippers on a lid, is positioned into a chamber by the positioning of the lid over the chamber. After a vacuum is formed in the chamber, and hence in each bag, the bags are sealed to provide a vacuum packed bag.

3 Claims, 7 Drawing Figures

PACKING APPARATUS

FIELD OF THE INVENTION

This invention relates to a rotary system vacuum packing apparatus, which is provided with a number of vacuum chambers and carries out vacuum packing mainly of juicy objects, such as pickles, in such a manner that bags containing the objects, while being supported in suspension by clamps, are supplied into chambers respectively.

BACKGROUND OF THE INVENTION

Recently, vacuum packing, as well-known, has been used for keeping food stuffs long. Especially in the United States of America, vacuum packing is largely effective for transporting butcher's meat without its becoming tainted from the slaughter-house in the inland area, to the cities or to foreign countries. Therefore, many vacuum packers which are used only for packing butcher's meat have hitherto been invented, for example, as disclosed in U.S. Pat. Nos. 3,780,486 and 3,958,391. These patents disclose vacuum packing systems which place on a table the butcher's meat wrapped by a plastic film or bag, cover it by a chamber, and exhaust air therefrom, thereby carrying out vacuum packing. Such packers for exclusive use of meat, however, even when intended to vacuum-pack juicy objects, such as pickles, cannot lay them on the table without leaking water. Even if the bag is kept upright on the table by use of a jig, the mouth of the bag is subjected to distortion to lower the sealing accuracy for the bag. As a result, it is very difficult for packer developed for exclusive use of meat to vacuum-pack such pickles. From the first, the juicy contents, such as pickles, have been canned or bottled and have never been vacuum-packed by use of bags of low material cost in comparison with cans or bottles for the aforesaid reason.

On the other hand, U.S. Pat. No. 3,982,376 discloses a rotary packer for packing juicy objects in a bag, but not by vacuum packing. This packer has numerous pairs of clamps fixed to a long endless chain, and disposes, along the path of the chain, units for feeding bags, containing therein objects to be placed, and sealing the bag's mouth, so that the bags are supplied one by one by the bag feed unit. The while being supported in suspension by pairs of clamps, are transported by the chain to receive the objects to be packed, and then a sealing-weld is effected at the mouth of each bag. If vacuum chambers corresponding in number to the pairs of clamps are incorporated into this packer, the packer can perform of vacuum packing, but vacuum chambers are expensive to produce. Thus, to provide an equal number of vacuum chambers and clamp pairs would be quite expensive. In other words, in the section of the apparatus wherein bags are fed to the clamps and wherein the bags are filled, the chambers should be open, whereby the vacuum chambers are superfluous during this part of the operation.

SUMMARY OF THE INVENTION

An object of the invention is to provide a packing apparatus including an endless chain stretched across at least two gears, a number of chambers provided at one gear, a number of lids provided at the chain and for closing the chambers respectively so that each bag suspended to the lid is exposed to a vacuum within each chamber at the one gear side, and a bag feed unit and an object supply unit with respect to each lid are provided at the other gear side, whereby a minimum number of vacuum chambers can efficiently vacuum-pack the juicy objects.

This invention is characterized in that the packing apparatus is provided with vacuum equipment, first and second gears rotatable around spaced apart vertical axes respectively and an endless chain stretched across the gears. The first gear is provided with a large number of chambers each having an opening directed radially outwardly of the first gear and communicating with the vacuum equipment. The chain is provided with a number of lids which are disposed at intervals equal to those between the chambers respectively and which close the openings of the chambers when they are passing around the first gear respectively. The lids are each being provided with a pair of clippers for hanging each bag containing therein the object to be packed and so as to orient the mouth of each bag upwardly. A bag feed unit feeds each bag to the clippers at each lid and is located at the chain exit side with respect to the first gear. A hopper means supplies into each bag the object to be packed and is located at the chain entrance side with respect to the first gear. The bag containing the object to be packed is hung by the clippers, such that the bag opening is oriented upwardly. The bag is exposed to a vacuum within the chamber closed by the lid. While the bag is in the vacuum chamber, a sealing means weld-seals the opening of the bag.

The packing apparatus of the invention constructed as foregoing can vacuum-pack successive objects, even relatively juicy objects, without leaking water therefrom to the exterior. Further the bag feed unit and the hopper means can be positioned independently of the position where the chambers are provided. Hence, the number of chambers is minimized so as to eliminate unnecessary chambers and ensure the feed of bag and object to be packed. Furthermore, each bag is hung keeping its opening oriented upwardly while exposed to a vacuum and is sealing-welded reliably without wrinkling.

The above and further objects and novel features of the invention will be more fully apparent from the following description in accordance with the accompanying drawings.

DETAILED DESCRIPTION OF THE INVENTION

Figure 1:
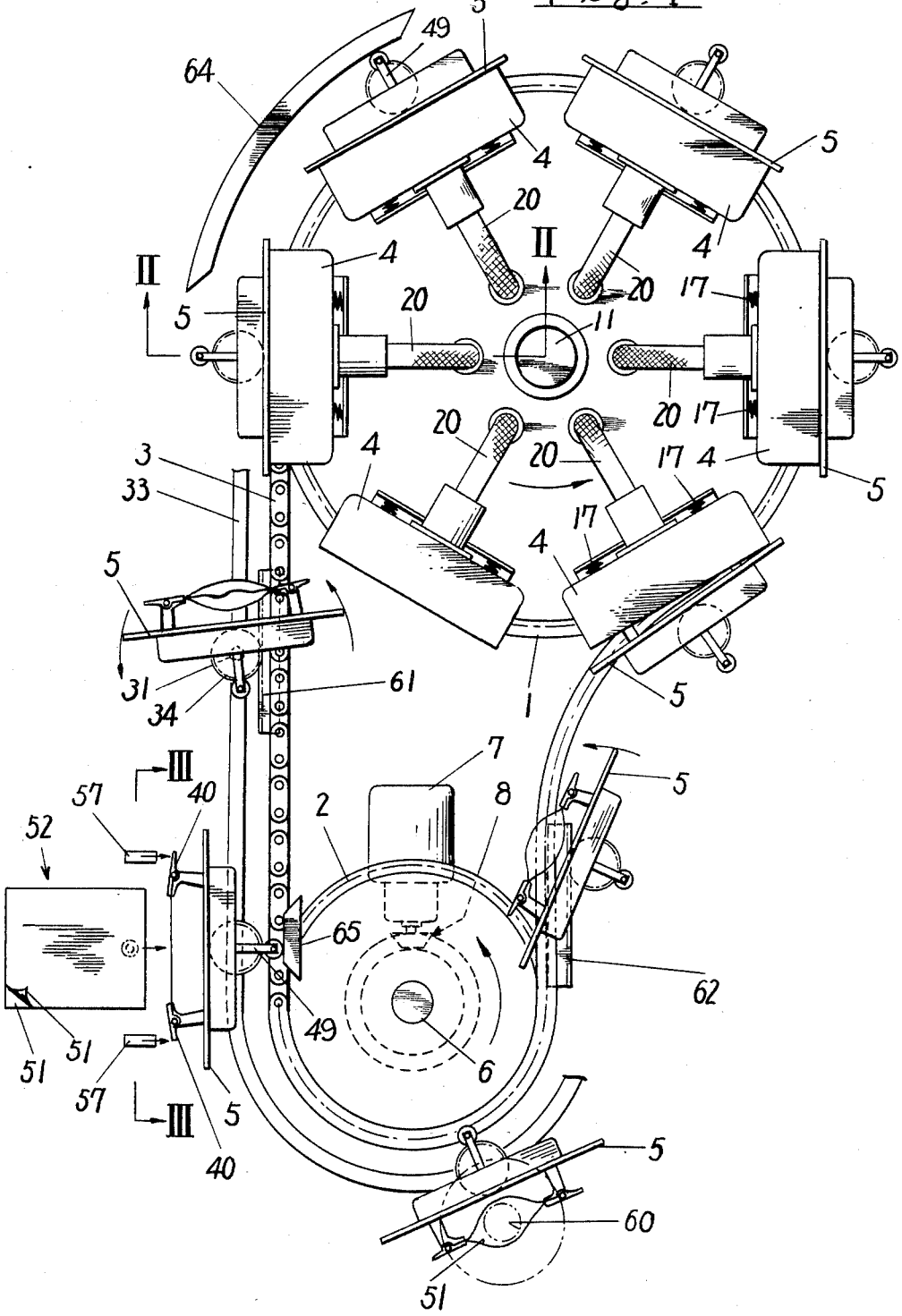
FIG. 1 is a plan view of an embodiment of a packer of the invention.

Referring to FIG. 1, a first larger diameter gear 1 and a second smaller diameter one 2 are supported rotatably to vertical shafts 11 and 6 erected on a base 10 and spaced at a given interval from each other and a long endless chain 3 is stretched across the gears 1 and 2, the first gear 1 carrying six chambers 4, the chain 3 carrying nine lids 5, the shaft 6 for the second gear 2 being connected through a bevel gear 8 to an electric motor 7 provided with reduction gears so that a driving power of motor 7 is transmitted to the chain 3 and first gear 1 through the second gear 2, thereby revolving the chambers 4 and lids 5 in synchronism with each other.

Figure 2:
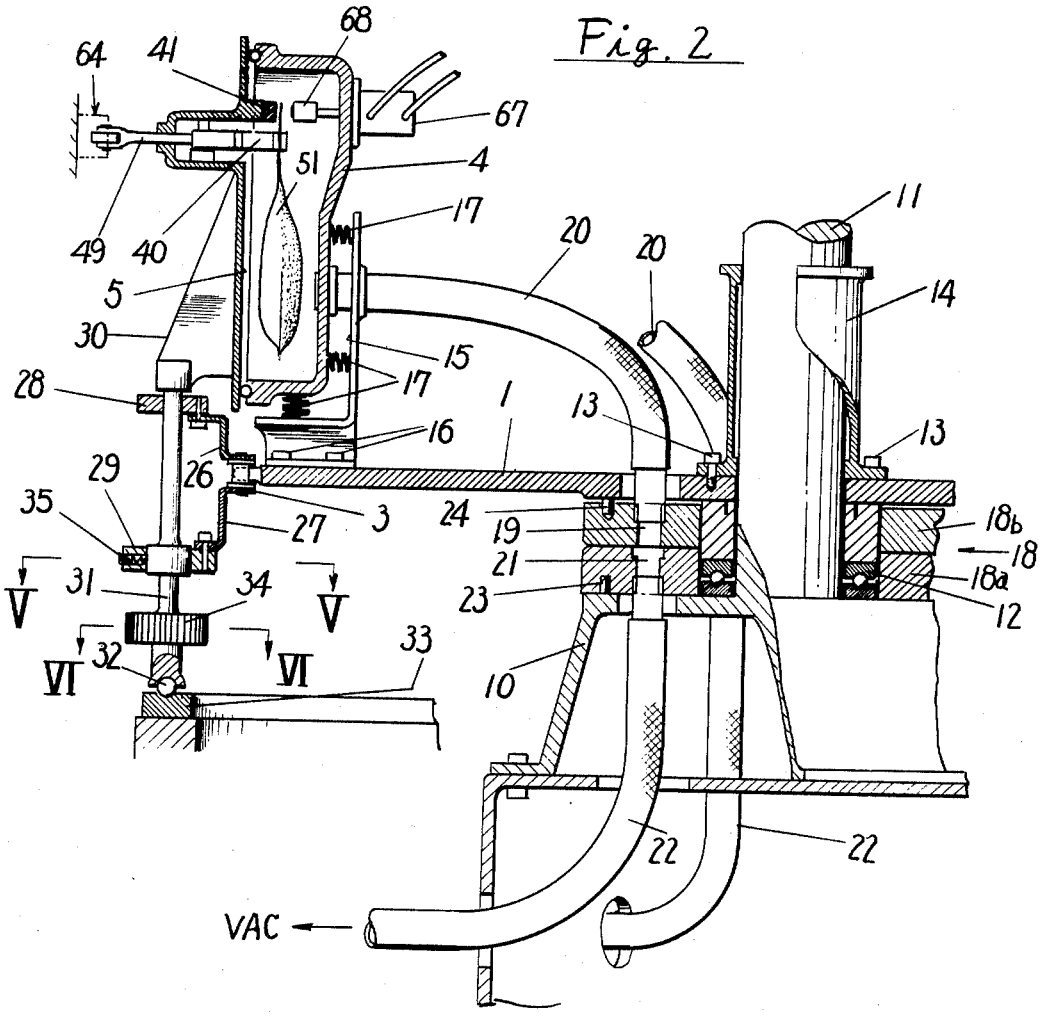
FIG. 2 is a sectional view taken on the line II—II in FIG. 1.

In FIG. 2, the first gear 1 supporting portion is shown in detail, in which the first gear 1 is supported through a ball bearing 12 to the shaft 11 and a sleeve 14 is fitted onto the shaft 11 and fixed to the upper surface of gear 1 through bolts 13 to thereby keep the gear 1 horizontally without tilting. At the outer peripheral portion of the upper surface of first gear 1, a number of L-like shaped brackets 15 are fixed through bolts 16 and support the respective chambers 4 through a plurality of coiled springs 17 in relation of keeping the chamber 4 directed at the opening thereof radially outwardly of the first gear 1 and buffered from any impact, thus disposing the six chambers 4 at six equal intervals with respect to the first gear 1. Also, between the base 10 and the first gear 1 is provided a doughnut-like-shaped rotary valve 18 comprising a lower slide base 18*a* and an upper slide valve 18*b*, the six chambers 4 are connected to six ports 19 at the upper slide valve 18*b* through six ducts 20 respectively, and a plurality (two or three) of ports 21 formed at the lower slide base 18*a* are connected to a vacuum pump (not shown) through ducts 22 respectively, the lower slide base 18*a* engaging with the base 10 through pins 23 and the upper slide valve 18*b* with the first gear 1 through pins 24, thereby enabling the slide valve 18*b* to rotate integrally with the first gear 1 on the slide base 18*a*.

Figure 5:
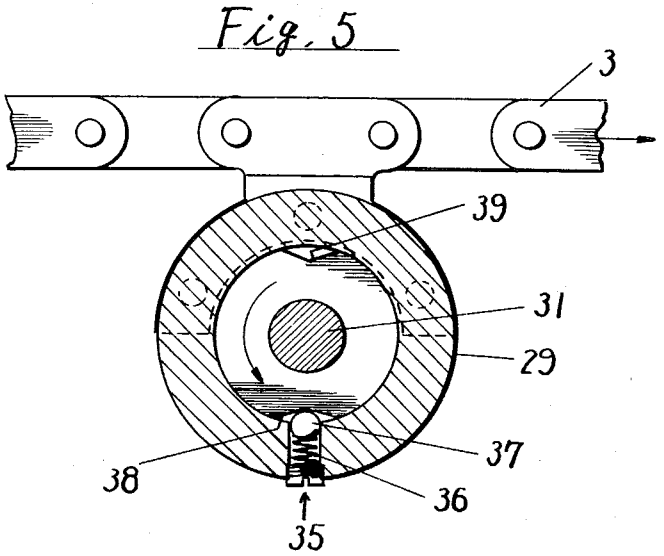

The chain 3 is divided into nine equal parts and the lids 5 are provided thereto at the intervals corresponding to those between the chambers 4 and is provided with upper and lower bearings 28 and 29 through segments 26 and 27 extending upwardly and downwardly from the chain link, each lid 5 having a support shaft 31 extending downwardly from the lower end of a rib 30 at the rear surface of lid 5 so that the support shaft 31 is supported by the bearings 28 and 29 to thereby mount the lid 5 rotatably to the chain 3. A ball 32 is fitted into the lower end of each support shaft 31 and brought into rotatable contact with a rail 33 laid in parallel to the path of chain 3, thereby bearing a load of each lid 5 on the rail 33. Also, a pinion 34 for rotating the lid 5 is fixed to each shaft 31 and a cushion stopper 35 is provided at the lower bearing 29. The cushion stopper 35, as shown in FIG. 5, comprises a tension spring 36 inserted into a bore bored at the lower bearing 29 and a ball 37, so the tension of spring 36 is applied through the ball 37 to a recess 38 or 39 formed at the outer periphery of support shaft 31, thereby restricting the rotation thereof to avoid useless rotation of each lid 5.

Figure 3:
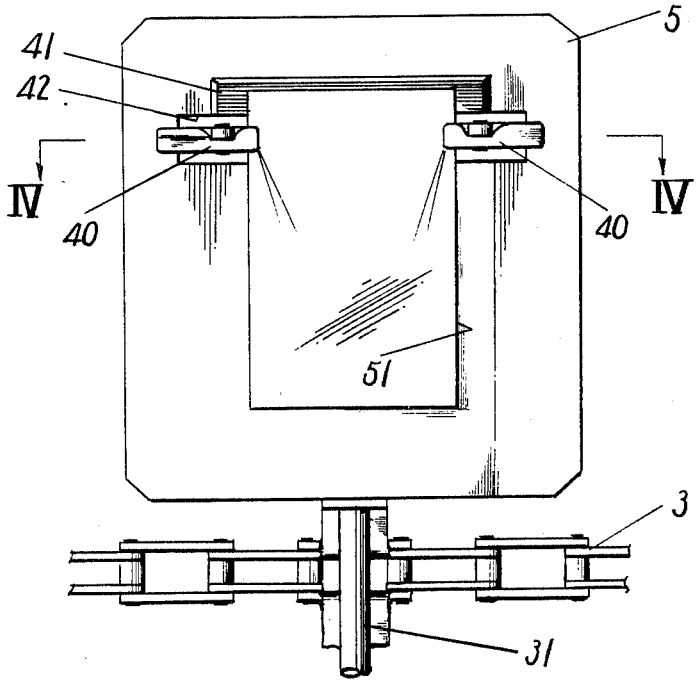
FIG. 3 is a view of the embodiment looking in the direction of the arrows III in FIG. 1.
Figure 4:
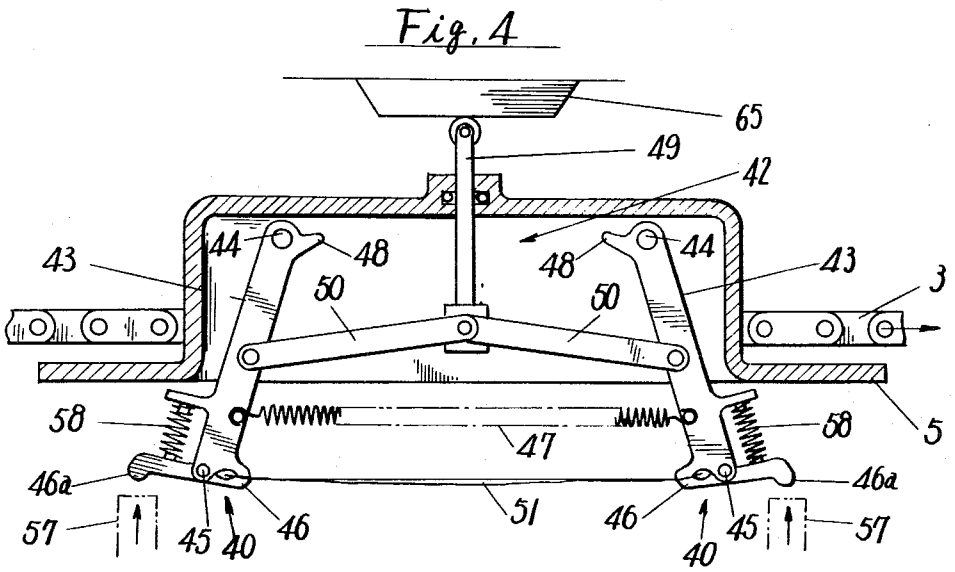
FIG. 4 is a sectional view taken on the line IV—IV in FIG. 3, and FIGS. 5 to 7 are illustrations of the FIG. 1 embodiment in part respectively.
Figure 6:
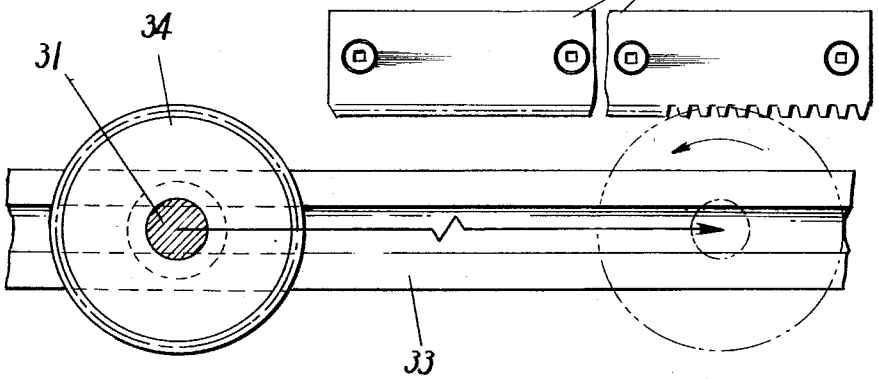

Referring to FIGS. 3 and 4, each lid 5 has at the inside a pair of clamps 40 and at the upper portion of the inner surface a sealing base 41, which is swollen at the lower portion outwardly to form a box-like chamber 42. A pair of clamp arms 43 are pivoted thereto through pins 44, the clamp arms 43 each carrying at the utmost end a clipper 46 through a pin 45, thereby forming each clamp 40. A tension spring 47 is provided between the clamp arms 43 to bias them toward each other and noses 48 control the clamp arms 43 to approach each other at a given interval. Furthermore, a rod 49 perforates the bottom wall of chamber 42 in an air-tight manner and connects with both the clamp arms 43 through a pair of links 50, so that the stroke of rod 49 moves the utmost ends of clamp arms 43 away from each other.

Figure 7:
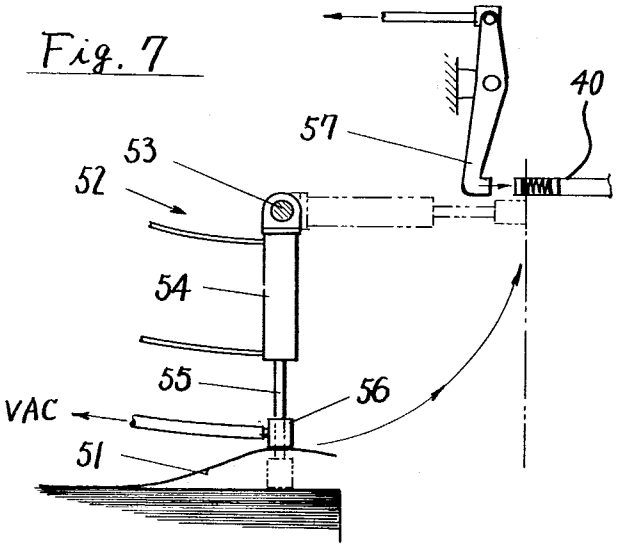

Now, as seen from FIG. 1, the chambers 4 are coincident in intervals therebetween with the lids 5 and the chain 3 is transported step by step at the interval between the respective lids 5 by means of the stepping motor 7. A bag feed unit 52, which stores therein a large number of bags 51 and feeds them one by one to the clippers 46, is provided opposite to the second gear 2 and at the position where each lid 5 carried on the chain 3 coming out from the first gear 1 stops as shown in FIG. 1. The bag feed unit 52, as shown in FIG. 7, comprises an air cylinder 54 connected to a shaft 53, a piston rod 55, and a suction cup 56 fixed to the utmost end thereof, and functions to attract each bag 51 by the suction cup 56 and turn the piston rod 55 through the rotating shaft 53, thereby supplying the bag 51 to the clamp means 40 when in existence, in which the clippers 46, when pushed by the push levers 57, open only when the bag 51 is supplied to the clamp means 40. In detail, referring to FIG. 4, the clippers 46 are open to form gaps receiving therein both ends of each bag 51 and when the push levers 57 are released, the clippers 46 clip the bag 51 at both ends thanks to tension of each spring 58. Also, in FIG. 1, a hopper means 60 is provided at the downstream side of bag feed unit 52 in the chain 3 transportation direction toward the first gear 1, thereby putting into each bag 51 an object to be packed. Also, a rack gear 61 for turning the lid 5 moving toward the second gear 2 is provided at the upstream side of bag feed unit 52 and that 62 for turning the lid 5 returning to the first gear 1, at the downstream side of hopper means 60, both the rack gears 61 and 62 being disposed in parallel to the path of the moving chain 3, rigidly mounted to the base 10, and engageable with the pinion 34 fixed to each support shaft 31 moving on the rail 33. Hence, each support shaft 31, in turn each lid 5, rotates at an angle of 180° to face outwardly or inwardly through the engagement of pinion 34 with the rack gear 61 or 62. In addition, the rack gears 61 and 62 are long just enough to allow the support shaft 31 to rotate at an angle of 180°. Also, as shown in FIG. 1, elongate cams 64 and 65 are provided at the sections outside and along the chain 3 in engagement with the first gear 1 and inside and along the same in engagement with the second gear 2, the cam 64 being disposed at an area where the opening of bag 51 is sealed within the vacuum chamber 4, the cam 65 being disposed opposite to the bag feed unit 52.

Next, explanation will be given on operation of the aforesaid embodiment.

Referring again to FIG. 1, the motor 7 is driven to rotate the second gear 2 step by step counterclockwise, the gear 1 rotates in the same directions through the chain 3, each chamber 4 and lid 5 move step by step at each installation pitch of lid 5. Then, each lid 5 comes into press-contact with the opening of each chamber 4 on the first gear 1 against the spring 17, revolves together with the chamber 4 in the predetermined distance while being coupled therewith, and thereafter leaves the chamber 4 and travels around the second gear 2. In this case, the lid 5 engages with the rack gear 61 through the pinion 34 at the position where the lid 5 leaves the first gear 1 to be transferred to the linear motion on the path of chain 3. Then, the support shaft 31 at each lid 5 rotates through engagement with the rack gear 61 as the chain 3 travels, thereby rotating the lid 5 at an angle of 180° to face outwardly, at which time the cushion stopper 35 engages with the recess 38 to stop the inertia of lid 5 as shown in FIG. 5. When the lid 5 outwardly facing stops temporarily at the position of bag feed unit 52, the bag 51 attracted to the suction cup 56 as shown in FIG. 7 is supplied to the clamp means 40. In this case, the rod 49 is subjected to the action of cam 65, and the clamp arms 43 at both sides are far apart from each other, thereby clipping by the clippers 46 the bag 51 at both sides thereof. When the lid 5 having received the bag 51 leaves the bag feed unit 52, the rod 49 leaves the cam 65 and the spring 47 pulls the clamp arms 43 and the opening of bag 51 is slackened to be open. The open bag 51 stops just below the hopper means 60 and receives an object to be packed. The lid 51 carrying the bag 51 containing therein the object to be packed, on the way of movement toward the first gear 1, engages with the return rack gear 62 through the pinion 34 to turn at an angle of 180° and face inwardly, and then travels to contact again with the chamber 4 at the first gear 1.

The chamber 4, when its opening is closed by the lid 5 as shown in FIG. 2, is connected to the vacuum pump through the ducts 20 and 22 and exhausts air from the chamber 4. The chamber 4, when moving stepwise around the first gear 1, is switched at the inside from the first vacuum pump to the second one through the rotary valve 18 to thereby prevent a short circuit in each chamber 4, thus raising a degree of vacuum therein. When the degree of vacuum in the chamber 4 becomes 760 mm Hg or approaches this value, the rod 49 is actuated by the cam 64 to move the clamp arms 43 away from each other, resulting in that the opening of bag 51 is stretched to smooth a wrinkle. In this state, the actuator 67 shown in FIG. 2 is subjected to a fluid pressure and the sealing bar 68 is pushed to melting-seal the opening of bag 51, and just thereafter the rotary valve 18 flows air into the chamber 4. Then, the lid 5 is disconnected therefrom and the clippers 46 at the clamp arms 43 are released at the position of bag feed unit 52 to drop the packed object and a new bag 51 is supplied to the lid 5.

As seen from the above, the packer of the invention constructed as described above can dispose the bag feed unit 52 and hopper means 60 at the position separate from the first gear, thereby being advantageous in that the chambers are free from the working place of the bag feed unit 52 and hopper means 60. Furthermore, since the bag 51 is stretched at the opening by the clippers 46 and hung by the clamps 40, it is possible to vacuum-pack the relatively juicy objects to be packed by use of bags of a low material cost. Also, the forward and backward rack gears 61 and 62 can carry out the supply of bags and objects to be packed and discharge of packed objects, outside the path of chain transportation, thereby improving the work efficiency.

While an embodiment of the invention has been shown and described, the invention is not limited to the specific construction thereof, which is merely exemplary in the specification rather than defined.

What is claimed is:

1. A vacuum packing apparatus for vacuum packing objects in flexible bags, said bags having openings for receiving said objects, said apparatus comprising:

a vacuum means;

a first vertical shaft;

a second vertical shaft spaced apart from said first vertical shaft;

at least one first gear rotatably disposed on said first shaft;

at least one second gear rotatably disposed on said second shaft;

an endless chain engaged with and connecting said first and second gears;

said first gear including an outer peripheral portion having an upper surface with a plurality of chambers spaced at intervals from one another, said chambers having openings facing radially outwardly relative to said first gear, said chambers being in fluid communication with said vacuum means;

said chain including a plurality of lids disposed at intervals coincident with said intervals between said chambers for closing said openings of said chambers of said first gear so that a vacuum can be formed in spaces defined by said respective chambers and lids;

each said lid including a pair of clippers disposed at a surface of each said lid which is opposite to a respective said chamber for holding successive individual ones of said bags in suspension, while maintaining said openings of said bags oriented in an upward direction;

a bag feed unit located at an exit side of said chain relative to said first gear for feeding said bags to said clippers;

a hopper means disposed at an entrance side of said chain relative to said first gear for feeding said objects into said bags while said bags are supported in suspension by said clippers; and a sealing means interposed between said chambers and said lids for heat sealing openings of said bags within said chambers after a vacuum has been formed within said chambers closed by said lids.

2. A vacuum packing apparatus according to claim 1, further comprising:

a plurality of vertical support shafts for rotatably supporting said lids to said chain, each said support shaft including a pinion for rotating a corresponding said lid;

a forward rack gear disposed at a path of movement of said chain between said first and second gears, for engaging with said pinion to cause forward movement of said lids, to turn said lids to an outwardly facing position from an inwardly facing position at which said lids face said openings of said chambers; and a backward rack gear disposed at a path of movement of said chain between said first and second gears, for engaging with said pinion to cause backward movement of said lids, to turn said lids from said outwardly facing position to said inwardly facing position.

3. A vacuum packing apparatus according to claim 2, wherein said bag feed unit and said hopper means are each disposed adjacent to said path of movement of said chain and between said forward and backward rack gears at a location along said path of movement of said chain downstream of said forward rack gear.

* * * * *